US005791761A

United States Patent [19]

Bryant et al.

[11] Patent Number: 5,791,761

[45] Date of Patent: Aug. 11, 1998

[54] WHEELCHAIR WARNING LAMP, UMBRELLA, AND ACCESSORY STORAGE APPARATUS

[76] Inventors: Connie Bryant, 1105 Nezperth Dr., Colorado Springs, Colo. 80915; Douglas H. Kirkpatrick, 8720 Anglewood Ct., Colorado Springs, Colo. 80920

[21] Appl. No.: 674,099

[22] Filed: Jul. 1, 1996

[51] Int. Cl.[6] ..... A47B 97/00

[52] U.S. Cl. ..... 362/131; 362/102; 362/127; 297/217.6

[58] Field of Search ..... 362/102, 131, 362/127, 431; 280/304.1; 297/184.16, 217.6

[56] References Cited

U.S. PATENT DOCUMENTS

| | | | |
|---|---|---|---|
| 2,089,727 | 8/1937 | Borden | 297/217.6 |
| 2,658,225 | 11/1953 | Bascom | 297/184.16 |
| 4,178,625 | 12/1979 | Schudel | 362/131 |
| 5,044,650 | 9/1991 | Eberle, Jr. | 280/304.1 |

*Primary Examiner*—Y. My Quach
*Attorney, Agent, or Firm*—Phillip A. Rein

[57] ABSTRACT

Many individuals in wheelchairs are struck by motor vehicles while crossing roadways. Usually motorists fail to see them. This invention provides for a warning lamp apparatus for a wheelchair comprising: a mounting base adapted to be slidingly received and removed from the upper rear portion of the wheelchair; an upright support member extending from the mounting base; a lamp mounted on the top portion of the upright member; an umbrella support arm connected to the mounting base and a power supply means to illuminate the lamp. A preferred aspect of this invention provides for an apparatus as above wherein the mounting base is a generally horizontal U shaped member having a box connected thereto and the U shaped member slidingly received in a rear upper portion of the wheelchair. The box is adapted to carry the umbrella support arm and provide accessory storage for the rider. The apparatus may be readily removed when the wheelchair is used indoors or quickly installed when the wheelchair is to be used out of doors.

18 Claims, 1 Drawing Sheet

WHEELCHAIR WARNING LAMP, UMBRELLA, AND ACCESSORY STORAGE APPARATUS

FIELD OF INVENTION

This invention relates to wheelchair accessories. More particularly this invention relates to an accessory apparatus which comprises a warning lamp to caution motor vehicles when approaching a wheelchair. Additionally, an umbrella which may be adjustably positioned over the wheelchair, and an accessory storage compartment which is also for the use of the wheelchair rider, are disclosed.

BACKGROUND OF THE INVENTION

Many individuals in wheelchairs are struck by motor vehicles while crossing roadways. Usually motorists fail to see them. Unlike an individual on foot, wheelchairs are unable to accelerate quickly or find some measure of safety between the lanes on a busy roadway. A lamp to attract attention and warn motor vehicles to slow down when approaching a wheelchair crossing the roadway is desperately needed. One problem with mounting a warning lamp on a wheelchair for use in traffic, is that it is difficult to adequately and removably support such a lamp to a wheelchair, so that it may be removed when the wheelchair is folded or used indoors.

OBJECTS AND STATEMENT OF INVENTION

It is an object of this invention to disclose a wheelchair warning lamp which may be easily and removably mounted on any wheelchair. It is an object of this invention to disclose a wheelchair apparatus which in addition to providing a mounting base for a warning light, additionally provides a mounting base for an umbrella and an accessory storage compartment for use of a wheelchair rider.

One aspect of this invention provides for a warning lamp apparatus for a wheelchair comprising: a mounting base adapted to be slidingly received and removed from the upper rear portion of the wheelchair; an upright support member extending from the mounting base; a lamp mounted on the top portion of the upright member; and, a power supply means to illuminate the lamp.

A preferred aspect of this invention provides for an apparatus as above wherein the mounting base is a generally horizontal U shaped member which may be slidingly received in a rear upper portion of a wheelchair. In the most preferred aspect of the invention the mounting base includes a box which is adapted to carry an umbrella support arm and provide accessory storage for a rider.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 2:
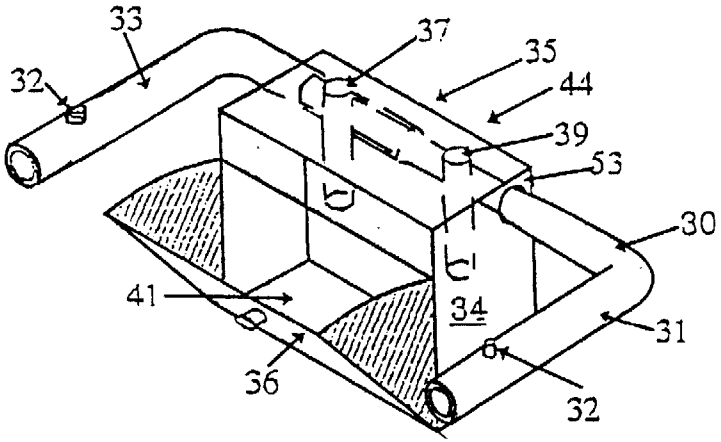
FIG. 2 is an enlarged perspective view of a mounting base used to support a warning lamp and an umbrella and being slidingly removed from the wheelchair. A door of an accessory storage compartment is shown in an open position.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
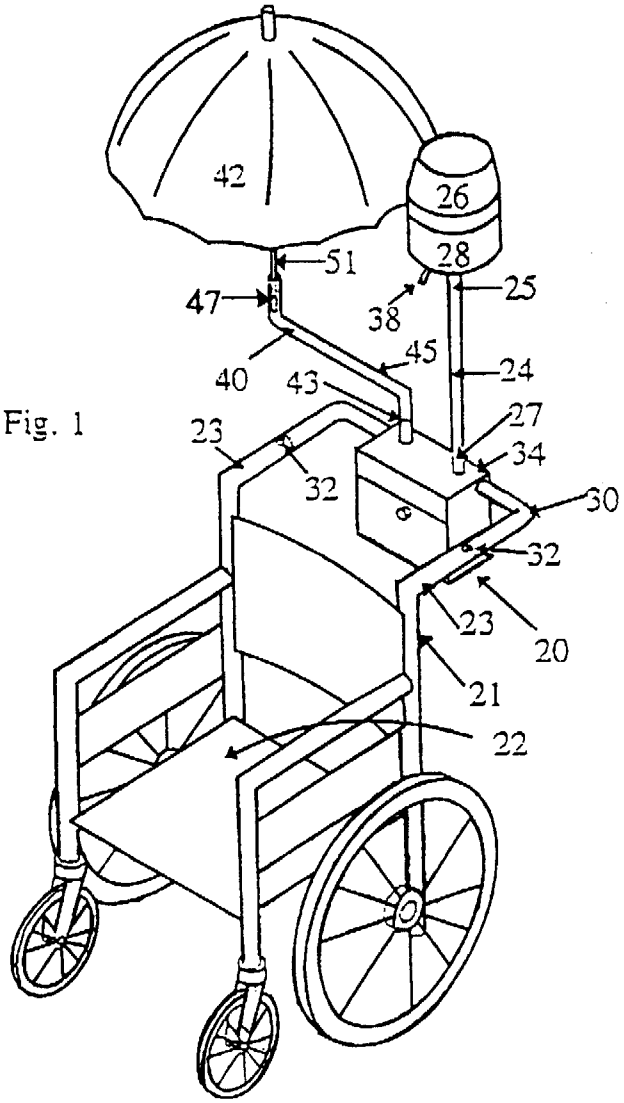
FIG. 1 is a perspective view of a wheelchair having a warning lamp, umbrella, and accessory storage apparatus mounted thereon.

Turning now to the drawings and more particularly to FIG. 1, a perspective view of a wheelchair warning lamp, umbrella, and accessory storage apparatus 20 is shown mounted on a wheelchair 22. The apparatus 20 comprises a mounting base 44 adapted to be slidingly received and removed from an upper rear portion 21 of a wheelchair 22; an upright support member 24 extending upwardly from the mounting base 44; a lamp 26 mounted on a top portion of the upright support member 24; an umbrella support arm 40 releasably connected to the mounting base 44 and a power supply means to illuminate the lamp 26.

The wheelchair 22 at the upper rear portion 21 is provided with spaced, parallel, guide support arms 23 having conventional grip members (not shown) thereon removed or altered as will be explained. Each guide support arm 23 is provided with an outer tubular opening to receive a portion of the mounting base 44 therein.

The mounting base 44 comprises a horizontal U shaped member 30 of tubular construction and connected to a box 34. Releasable locking means which preferably are spring loaded buttons 32 are provided on respective opposite parallel ends or side portions of the horizontal U shaped member 30. In a preferred embodiment, the U shaped member 30 comprises a left side portion 31 and a right side portion 33, one of which slides or telescopes within the other by telescoping end portions 35 so that the U shaped member 30 may be used on wheelchairs 22 of variable width. Most preferably, the box 34 includes a front side panel 36 which hingably opens forwardly to facilitate storage therein. The box 34 is provided with an umbrella support tube 37, a lamp support tube 39, and a bottom wall 41 for reasons to be explained. Most preferably the U shaped member 30 extends through a top portion 53 of said box 34. This design is not only more aescetically pleasing, but additionally stronger.

The power supply means comprises an electric battery 28 which is connected through a toggle switch 38 to the lamp 26. The lamp 26 is preferably one similar to those employed on emegency vehicles such as a revolving or strobe type lamp 26. The color of the glass on the lamp 26 may be selected for the particular application. In one aspect of the invention the battery 28 and switch 38 are housed and mounted immediately beneath the lamp 26. In a second aspect of the invention, the battery 28 is housed in the box 34. The switch 38 as before remains mounted immediately below the lamp 26. This position is most convenient for access either to an individual pushing the wheelchair 22, or to an individual riding therein.

The upright support member 24 is generally vertically seated in the lamp support tube 39 in said box 34. When lifted vertically it may be removed therefrom. The upright support arm 24 includes an upper support section 25 integral with a lower support section 27. The umbrella support arm 40 has a first support section 43 generally vertically and pivotably seated in the umbrella support tube 37 in said box 34. The umbrella support arm 40 is provided with a lateral support section 45 connected to the first support section 43 so that it may be rotated to allow optimal positioning. An umbrella 42 is held in an upright position on an umbrella support section 47 of the umbrella support arm 40. It is a simple procedure to adapt a center support arm 51 of the umbrella 42 by removing a handle member to be accepted in an outer hole into the umbrella support section 47 of the umbrella support arm 40. In addition to providing protection from rain, the umbrella 42 also offers protection from the sun. Those umbrellas 42 having the telescoping center support arm 51 which close to generally 18" long are particularily convenient to carry in a closed position on the wheelchair 22.

The box 44, forming part of the mounting base 34, is generally 12" high, 6" wide and 18" long. While the U shaped member 30 is made from metal tubing the box 34 may be either made of metal or extruded plastic. The box 34 of reduced length, say 12" instead of 18" may be provided for smaller wheelchairs 22.

The mounting base 44 is generally simple to install on the wheelchair 22. Initially the handle grips (not shown) on the rear portion of the wheelchair 22 must have their rear portions removed so that the left and right side portions 31, 33 of the U shaped member 30 may slide into the respective guide support arms 23. It is also necessary to drill through the guide support arms 23 and the underlying frame to provide holes for the spring loaded buttons 32. Thereafter it is only necessary to depress the buttons 32 in order to horizontally slide the U shaped member 30 on or off of the guide support arms 23 of the wheelchair 22. The entire wheelchair warning lamp, umbrella, and accessory storage apparatus 20 can be readily removed from the wheelchair 22 when so desired. Also, the upright support member 24 with attached lamp 26 can be removed from the box 34 for use as an independent guide light or strobe signal light when deemed necessary. The umbrella support arm 40 with the umbrella 42 mounted thereon can be selectively pivoted about the first support section 43 when mounted in the umbrella support tube 37. This allows the umbrella 42 to be positioned to shield to shield against the sun's rays or directly over the rider in the wheelchair 22 to shield against rain drops.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivilent relationships to those illustrated in the drawings, and described in the specification, are intended to be encompassed in this invention. What is desired to be protected is defined by the following claims.

I claim:

1. A warning lamp apparatus for a wheelchair, comprising:

a) a mounting base slidingly received in and removed from an upper rear portion of a wheelchair;

b) an upright support member extending from the mounting base;

c) a lamp mounted on a top portion of the upright support member; and d) a power supply means having an electrical battery connected to one of the mounting base and the support member and a switch connected to said lamp and said battery to selectively illuminate the lamp.

2. An apparatus as described in claim 1 wherein said upper rear end portion includes a plurality of spaced guide support arms, said mounting base comprises a generally horizontal U shaped member releasably connected to said spaced guide support arms on the wheelchair.

3. An apparatus as described in claim 2 wherein the U shaped member is of a tubular construction and has releasable locking means on opposite side portions thereof being engaged with the guide support arms on the wheelchair when connected thereto.

4. An apparatus as described in claim 3 wherein the locking means comprises a spring loaded button engageable with a locking hole in respective ones of the guide support arms.

5. An apparatus as described in claim 2 wherein the U shaped member comprises a left side portion and a right side portion interconnected at said portions, one of the side portions which slides within another of the side portions in a telescoping relationship so that the U shaped member may be mounted on the upper rear portions of wheelchairs of variable width.

6. An apparatus as described in claim 2 wherein the U shaped member extends through a portion of a box connected to the U shaped member.

7. An apparatus as described in claim 2 wherein the upright support member is generally vertically seated in a lamp support tube in a box connected to the U shaped member.

8. An apparatus as described in claim 7 further comprising an umbrella support arm which is generally vertically and pivotably seated in the box.

9. An apparatus as described in claim 8 wherein said umbrella support arm is provided with a horizontal portion so that it may be rotated about an umbrella support tube in the box to allow selective optimal positioning of an umbrella connected to said umbrella support arm over and laterally positioned of the wheelchair.

10. An apparatus as described in claim 1 wherein the mounting base includes a box having a side panel which hingably opens to facilitate storage therein.

11. An apparatus as described in claim 6 wherein the side panel being a front side panel which hingably opens towards the wheelchair when connected thereto to facilitate storage therein.

12. An apparatus as described in claim 2 wherein the electric battery is mounted in a box connected to the U shaped member and the lamp is a strobe light.

13. An apparatus as described in claim 1 wherein:

a) said mounting base includes a generally horizontal U shaped member having the box connected thereto; and b) the box receiving and supporting the upright support member above the upper rear portion of the wheelchair.

14. An apparatus as described in claim 13 wherein:

a) the lamp is a revolving strobe light.

15. An apparatus as described in claim 13 wherein:

a) the U shaped member includes a left side portion and a right side portion, one of the side portions slides within another one of the side portions so that the U shaped member may be used on wheelchairs having guide support arms spaced from each other at variable width.

16. A warning lamp apparatus for a wheelchair, comprising:

a) a mounting base includes a generally horizontal U shaped member including a box mounted thereto;

b) the U shaped member is a round tube and has releasable locking means on opposite ends thereof;

c) said U shaped member slidingly received in and removed from an upper rear portion of a wheelchair;

d) an upright support member extending from the mounting base;

e) a lamp mounted on a top portion of the upright support member;

f) a power supply means comprises an electric battery which is connected through a switch to the lamp to illuminate the lamp; and g) said power supply means connected to the box.

17. A warning lamp apparatus for a wheelchair, comprising:

a) a mounting base including a box slidingly connected to and selectively removed from an upper rear portion of a wheelchair;

b) an upright support member releasably connected to the mounting base;

c) a lamp mounted on a top portion of the upright support member; and d) a power supply means having an electric battery connected to the mounting base and electrically connected to the lamp to selectively illuminate the lamp which illuminates an area over and about the wheelchair.

18. An apparatus as described in claim 17, including:

a) an umbrella support arm which is generally vertically and pivotably seated in a box connected to the U shaped member;

b) the umbrella support arm is provided with a horizontal portion so that it may be rotated over and laterally positioned relative to the wheelchair; and c) an umbrella connected to the umbrella support arm.

* * * * *